US006349702B1

(12) United States Patent
Nishiyama

(10) Patent No.: US 6,349,702 B1
(45) Date of Patent: Feb. 26, 2002

(54) COMMON-RAIL FUEL-INJECTION SYSTEM

(75) Inventor: Yasuhiro Nishiyama, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/662,878

(22) Filed: Sep. 15, 2000

(30) Foreign Application Priority Data

Sep. 20, 1999 (JP) ..... 11-265194

(51) Int. Cl.[7] ..... F02M 41/00
(52) U.S. Cl. ..... 123/456; 123/494; 123/447
(58) Field of Search ..... 123/447, 456, 123/299, 300, 446, 357, 494

(56) References Cited

U.S. PATENT DOCUMENTS

| | | | | | |
|---|---|---|---|---|---|
| 5,176,122 | A | * | 1/1993 | Ito | 123/447 |
| 5,937,826 | A | * | 8/1999 | Olson et al. | 123/447 |
| 5,992,373 | A | * | 11/1999 | Hosoya et al. | 123/305 |
| 6,053,147 | A | * | 4/2000 | Hemmerlein et al. | 123/447 |
| 6,085,727 | A | * | 7/2000 | Nakano | 123/447 |
| 6,142,121 | A | * | 11/2000 | Nishimura et al. | 123/447 |

FOREIGN PATENT DOCUMENTS

| | | |
|---|---|---|
| JP | 186034/1987 | 8/1987 |
| JP | 203441/1992 | 7/1992 |
| JP | 203451/1992 | 7/1992 |
| JP | 203452/1992 | 7/1992 |

* cited by examiner

*Primary Examiner*—Carl S. Miller
(74) *Attorney, Agent, or Firm*—Browdy and Neimark

(57) ABSTRACT

A common-rail fuel injection system is disclosed, which calculates a mean value of common-rail pressures that remain pulsating after pressure drop due to any fuel injection, and considers the mean value to be a net common-rail pressure after fuel injection thereby finding with accuracy an amount of fuel to be injected. The common-rail pressure kept constant before the beginning of the fuel injection starts pulsating due to a pressure surge or oil hammer resulting from the fuel injection. The mean value is derived from the common-rail pressures sensed over a time interval for data sampling, which starts with the beginning of the command pulse. The mean value may be considered to be an approximation close to the net common-rail pressure that has fallen due to the fuel injection. The amount of fuel injected, as given depending on a net amount of pressure drop from the pressure before any fuel injection to the mean value, may be found accurately irrespective of characteristic deviation every injector.

9 Claims, 11 Drawing Sheets

COMMON-RAIL FUEL-INJECTION SYSTEM

BACKGROUND OF THE INVENTION

1. Field of the Invention

The present invention relates to a common-rail fuel-injection system in which a series of injectors admits the fuel charge to each combustion chamber from a common rail filled with fuel maintained at a high pressure.

2. Description of the Prior Art

Common-rail fuel-injection systems have been conventionally known as the most suitable way to increase injection pressures and also control fuel-injection factors such as injection timing, amount of fuel injected per cycle and the like, depending on engine operating conditions. Among the prior common-rail fuel-injection systems there is a fuel-injection system in which working fluid for fuel injection pumped up to a preselected pressure is accumulated in a common rail to actuate injectors, which are arranged in individual cylinders, each to each cylinder. Fuel is charged out of the injectors into their associated combustion chambers by making use of the hydraulic pressure in the working fluid. A control unit governs valves installed in the individual injectors to inject the fuel with the fuel-injection factors optimal to the engine operating conditions.

In contrast, the common-rail fuel-injection system of fuel-pressure actuated type has been known in which fuel serves as the working fluid. In this type of fuel injection, the fuel pressures corresponding to the injection pressures are continually maintained in fuel passages from the common rail through injection lines to injection orifices formed at the distal ends of the injectors. Each injector is provided with a control valve allowing to flow or blocking the fuel supplied through the injection lines, and a solenoid-operated actuator to drive the control valve. A control unit regulates the fuel pressures in the common rail and the operation of the solenoid-operated actuators to inject the pressurized fuel out of the individual injectors in accordance with the injection factors most suitable for the engine operating conditions. Moreover, a further another type of the common-rail fuel-injection system has been proposed, in which the working fluid is provided by engine oil stored at a high pressure in the common rail. The engine oil applied to pressure chambers in the injectors from the common rail provides hydraulic pressures to boost the fuel in pressure to a desired pressure, which is supplied into intensifying chambers in the injectors.

Referring to FIG. 7, the prior common-rail fuel-injection system of fuel-pressure actuated type will be explained in detail hereinafter. Fuel drawn in by a fuel-feed pump 6 from a fuel tank 7 is applied to a high-pressure fuel-supply pump 1, which is a variable-delivery high-pressure plunger pump driven from an engine to force the fuel into a common rail 2. The fuel stored at high pressure in the common rail 2 is allowed to pass through injection lines 23 included in a fuel passage system to injectors 3, which are installed in the cylinders, each to each cylinder, in accordance with the type of engine. The fuel finally is injected out of the individual injectors into their associated combustion chambers. The high-pressure fuel-supply plunger pump 1, besides the type illustrated, may be any one of rotary-plunger pump and inline-plunger pump in accordance with the type of engine.

The high-pressure fuel-supply plunger pump 1 has a cam 10 driven by the engine output to operate the pump, and a plunger 11 riding on the cam 10 to move in and out, with the plunger 11 forming at its top surface a part of the inside barrel wall defining a pumping chamber 12. An inlet valve 15 is arranged between the pumping chamber 12 and a fuel inlet line 13, and acts to regulate an amount of fuel forced into the pumping chamber 12 from the fuel-feed pump 6 through the fuel inlet line 13. A non-return valve 17 is disposed along a fuel discharge line 14 connecting the pumping chamber 12 with the common rail 2, and may open when the pressure created by the high-pressure fuel-supply plunger pump 1 is become over a preselected delivery pressure.

In order to keep the common-rail pressure from unexpected rise due to, for example, abnormality in control system, there is a relief valve 20, normally closed, which may open when subjected to a higher pressure than a preselected pressure, permitting the fuel held in the common rail 2 to escape to the fuel tank 7 through a relief line 21 with the result of reducing the common-rail pressure. Moreover, a pressure detector 22 monitors the common-rail pressure Pr, which is in turn signaled to a control unit 8 of electronic controlled module, which is commonly contracted to EMC.

The injectors 3 are hermetically fitted with sealing members in holes bored in a base member such as a cylinder head. The injectors 3 each comprise a needle valve 31 movable up and down in a injector body, injection orifices 32 formed at an distal end of an injection nozzle to open when the needle valve 31 lifts off its seat, thereby allowing the fuel injection into a combustion chamber, not shown. The needle valve 31 has a top surface 33 that provides a part of a balance chamber 30, which is applied with the high-pressure fuel from the associated injection line 23. A fuel passage 34 connected with the injection line 23 is opened to a fuel sac 35 formed around the needle valve 31. The needle valve 31 exposed to the fuel sac 35 is subject to the fuel pressure at its first tapered surface 36, thus encountering the hydraulic force to lift the needle valve 31. On the other hand, the needle valve 31 encounters both of the downward thrust due to the fuel pressure in the balance chamber 30 and the return force of a return spring 47.

While the high-pressure fuel in the common rail 2 is supplied to the balance chamber 30 through a fuel supply line 38 branching off from the injection line 23, the fuel in the balance chamber 30 is expelled through a drain line 40. The fuel supply line 38 and drain line 40 are provided respectively with throats 39, 41, that are defined such that the throat 41 is larger in effective cross-section area than another throat 39. Moreover, the drain line 40 is provided therein with a valve 44, which is to relieve the fuel in the drain line 40 to a fuel return line 46.

Lift of the needle valve 31 depends on a kinetic balance among the upward and downward hydraulic forces and the return force. Control current from the control unit 8 energizes a solenoid 45 to open the valve 44 in the drain line 40. Thus, since the fuel flow at the throat 39 is more restricted than at the throat 41, the fuel pressure in the balance chamber 30 drops so that the force to lift the needle valve 31 off the seat overcomes the sum of the depressing force resulting from the fuel pressure in the balance chamber 30 and the resilient force of the return spring 47 to allow the needle valve 31 lifting off the seat with the fuel being injected out of the injection orifices 32 into the combustion chamber, not shown. As the valve 44 is made closed, the fuel pressure restored in the balance chamber 30 brings a second tapered surface 37 nearby the distal end of the needle valve 31 into engagement with a tapered valve seat to block the fuel passage between the injection orifices 32 and the fuel sac 35. Thus, the fuel injection ceases. The unconsumed fuel remaining the injector may be expelled out of the balance chamber 30 through the drain line 40 and recovered into the fuel tank 7 through the fuel return line 46.

The control unit 8 is applied with various signals of sensors 9 such as a crankshaft position sensor for detecting the engine rpm Ne, an accelerator pedal sensor for detecting the depression Ac of an accelerator pedal, and so on. The sensors 9 signaling the control unit 8 may also include other sensors for monitoring the engine operating conditions, for example, an engine coolant temperature sensor, an engine cylinder identifying sensor, a top dead center detection sensor, an atmospheric temperature sensor, an atmospheric pressure detector, an intake manifold pressure detector, and so on.

The control unit 8, on the basis of an injection characteristics map stored previously in memory, finds desired injection factors in accordance with the signals issued from the diverse sensors 9, and the valve 44 opens and closes, depending on the desired injection factors, to control the lift of the needle valve 31. The desired injection factors are defined to determine an injection timing and an amount of fuel injected out of the injector 3 per cycle so as to make the engine output optimum for the engine operating conditions. The injection timing and the amount of fuel injected are dependent upon injection pressure as well as the lift, or amount and duration of lift, of the needle valve 31. The control unit 8 issues a command pulse to determine a driving current to energize the solenoid 45, which in turn opens and closes the valve 44.

Especially, the relation between the amount of fuel injected out of the injector 3 and the pulse width of the command pulse issued from the control unit 8 is plotted in terms of a parameter: common rail pressure Pr, or fuel pressure in the common rail 2. The injection timing may be controlled by governing the time the command pulse is turned on/off, because the fuel injection starts or ceases with a preselected delay of time after a time either the command pulse falls or rises. Relation between the fundamental amount of fuel injected and the engine rpm Ne is stored previously in a map of fundamental amount characteristics of fuel injected, in which they are plotted in terms of a parameter: accelerator-pedal depression Ac. Thus, the amount of fuel injected may be calculated on the basis of the map of fundamental amount characteristics of fuel injected, depending on the engine operating conditions. Although but only one injector 3 is shown in the illustrative example, the engine of this type is usually a multi-cylinder engine, for example, a four-cylinder engine or six-cylinder engine, and the control unit 8 controls individually the fuel injection for every injector 3 installed in each cylinder.

As the injection pressure to inject the fuel out of the injector 3 is substantially equal the fuel pressure held in the common rail 2, the control of the common-rail pressure Pr results in controlling the injection pressure. Even if the engine operating conditions were held unvaried, the common-rail pressure Pr would drop due to fuel consumption at every fuel injection. In contrast, when the engine operating conditions change, the common-rail pressure Pr should be either increased or decreased to other common-rail pressure optimum for the changed engine operating conditions. The pressure rise in the common-rail pressure Pr is accomplished by intensifying the fuel supply from the high-pressure fuel-supply plunger pump 1, whereas the pressure decrease may be made by either fuel leakage out of the injector 3 or other suitable means, for example, a relief valve installed along the common-rail 2. The control unit 8 regulates amount delivered out of the high-pressure fuel-supply plunger pump 1 to keep the fuel pressure in the common to rail 2 at the preselected pressure or change continually it to the pressure required for the varied engine operating conditions.

For regulating the common-rail pressure Pr, a desired common-rail pressure is first found dependent on the desired amount of fuel to be injected and engine rpm Ne, which are determined in accordance with the engine operating conditions. Then, the amount of fuel delivered out of the high-pressure fuel-supply plunger pump 1, or the amount of fuel corresponding to the effective stroke of the plunger, is subjected to the feedback control to eliminate the deviation of actual common-rail pressure detected at the pressure detector 22 from the desired common-rail pressure.

Among prior systems to regulate the amount of fuel delivered out of the high-pressure fuel-supply plunger pump 1 in the common-rail fuel-injection system shown in FIG. 7, there has been a system that is termed pre-stroke control, in which an inlet valve 15 is controlled according to the pre-stroke way. According to the pre-stroke way, the fuel admitted in the pumping chamber 12, although but allowed to return through the fuel inlet line 13 to the fuel tank 7 as long as a fuel inlet valve 15 in the fuel inlet line 13 is kept open, even during the lift stroke of the plunger 11, is forced towards the delivery side of the pump just after the inlet valve 15 has been closed, thereby controlling the amount of fuel at the delivery side of the pump. The control unit 8 regulates a duration during which a solenoid 16 is kept energized, thereby governing fuel-delivery duration ranging from the timing for closure of the inlet valve 15 to the timing the plunger 11 reaches top dead center to adjust the amount delivered out of the high-pressure fuel-supply plunger pump 1, finally controlling the common-rail pressure Pr. As there is provided a relief valve 18 to set an upper limit on the fuel pressure, or feed pressure, in the inlet line 13, excess fuel fed from the fuel-feed pump 6 is left returned through the relief valve 18 and return fuel return line 19 to the fuel tank 7.

There is a predetermined relation between the amount of fuel injected and the amount of pressure drop in the common-rail pressure resulting from the fuel injection. On the other hand, the amount of fuel injected varies every injector 3 because of unavoidable variance in mechanical characteristics and aging of the individual injectors. Thus, there has been proposed a concept to compensate for the variations in the amount of fuel injected, in which the amount of fuel to be injected is anticipated on the basis of the amount of pressure drop given from a waveform showing the variations in the common-rail pressure. The above concept is disclosed in, for example, Japanese Patent Laid-Open Nos. 186034/1987, 203441/1992 and 203451/1992.

Incidentally, as both the high-pressure fuel-supply pump and the injectors are connected to the common rail, a series of the fuel deliveries out of the high-pressure fuel-supply pump and/or the fuel injections with a very small interval between each delivery and/or injection leads to an oil hammer or pressure surge in the common rail. As will be seen from FIGS. 13 and 16, the oil hammer following each fuel injection continues to pulsate for a considerable length of time still after the end of the fuel injection. Nevertheless, there is no prior fuel-injection system that has any consideration for the vibration or pulsation in the common-rail pressure resulting from the fuel injection.

In accordance with an example of prior fuel-injection systems, a deviation of a peak value in the common-rail pressure after the beginning of the fuel injection from a common-rail pressure just before the fuel injection is considered an amount of pressure drop in the common-rail pressure caused by the fuel injection, from which an actual amount of fuel to be injected is derived.

In the prior fuel-injection systems constructed as described above, however, the extreme value in amounts of pressure drop appearing in the common-rail pressure owing to the fuel injection varies dependent on a distance of every injector spaced apart from the pressure detector, even if the individual injectors are equal to each other in their mechanical characteristics and amounts of fuel to be injected. When the engine operating condition affects the common-rail pressure in its pressure average and/or the command pulse in its pulse width, moreover, the pulsation in the common-rail pressure experiences the changes in its period and amplitude whether the amount of fuel injected is the same or not, and correspondingly the extreme value varies. Accordingly, even if the peak value in pulsation of the common-rail pressure were held and the deviation of the held peak value from the common-rail pressure before any pressure drop were calculated, it would be very hard to predict the actual amount of fuel injected.

Another prior fuel-injection system seeks to make as small as possible the variations in the common-rail pressure, which might result from the fuel injection that is carried out along the fuel delivery out of the high-pressure fuel-supply pump, by stopping the high-pressure fuel-supply pump. Rendering the high-pressure fuel-supply pump inoperative when the engine operates actually results in the common-rail pressure going on decreasing. Thus, much variation appears in the common-rail pressure to cause the scattering or variance in amount of fuel injected and combustion every cylinder. If any learning made it possible to monitor the common-rail pressure, the problem raised due to the pulsation of the common-rail pressure would remain unsolved.

Since the high-pressure fuel-supply pump continues to apply the fuel to the common rail even when the pressure detector is checking the amount of pressure drop in the common-rail pressure resulting from every fuel injection, it becomes often tough to measure with accuracy the amount of pressure drop in the common-rail pressure. To cope with this, it has been proposed, as disclosed in Japanese Patent Laid-Open No. 203452/1992, to control the amount of fuel delivered out of the fuel-supply pump so as to make the common-rail pressure coincide with a desired pressure, thereby sensing with much precision the amount of pressure drop in the common-rail pressure resulting from every fuel injection.

General speaking, in the common-rail fuel-injection systems, the sudden pressure drop caused in the common-rail pressure owing to the fuel injection leads to the pressure surge or oil hammer in the common rail, which keeps on pulsating or vibrating for a length of time after the end of the fuel injection. The pulsation or vibration experiences much change in its waveform, depending on the mechanical characteristics and aging of the individual injectors, the position and/or arrangement of the individual injectors along the common rail, and the pressure average of the common-rail pressure and the command pulse width, which are adjusted in accordance with the engine operating conditions. Especially, a fuel-injection system in which a minute pilot injection is made prior to a major fuel injection is apt to undergo much variation in the amount of fuel charged in pilot injection every cylinder because the amount of fuel in pilot injection is very minute.

Thus, it will be anticipated to make reasonable estimates of the common-rail pressure just after any fuel injection on the basis of the common-rail pressure keeping on pulsating or vibrating still after the pressure drop caused by the fuel injection, thereby calculating a reasonable amount of fuel to be injected at every injector.

SUMMARY OF THE INVENTION

The present invention, therefore, has as its principal object the improvement in a common-rail fuel-injection system in which a sudden pressure drop caused in a common-rail pressure owing to any fuel injection leads to a pressure surge or oil hammer in a common rail, which keeps on pulsating or vibrating for a length of time after the end of the fuel injection, and the pulsation or vibration experiences much change in its waveform, depending on mechanical characteristics and aging of the individual injectors, positions and/or arrangements of the individual injectors along the common rail, and a pressure average of the common-rail pressure and a command pulse width, which are adjusted in accordance with the engine operating conditions. The present invention more particularly provides a common-rail fuel-injection system that is so constructed as to measure a reasonable and steady amount of pressure drop, which might occur in a common-rail pressure owing to a fuel injection, irrespective of the variations in waveform of the pressure surge keeping on pulsating still after the end of the fuel injection, and find a desirable amount of fuel to be injected actually, thereby helping ensure the reduction in engine vibration, noise and fuel consumption as well as the good emission-control.

The present invention is concerned with a common-rail fuel-injection system; comprising a common rail to store therein pressurized fuel, injectors each of which is arranged in every cylinders, to inject the fuel supplied from the common rail into the cylinders, sensor means to monitor engine operating conditions, a pressure detector to monitor pressure in the common rail, and a control unit to find fuel-injection factors including a desired amount of fuel to be injected, depending on signals detected from the sensor means, and further calculate an amount of pressure drop taking place in the common-rail due to an fuel injection of each injector, depending on signal detected from the pressure detector, thereby compensating for the desired amount of fuel about each injector, depending on a deviation of an actual amount of fuel injected from each injector, which is found based on the amount of pressure drop, from the desired amount of fuel to be injected, and wherein the control unit calculates a mean pressure after fuel injection by averaging pulsating pressures that occur in the common rail owing to the fuel injection, and derives the amount of pressure drop in the common rail from a difference in pressure between the mean pressure after fuel injection and a pressure before fuel injection in the common rail.

In accordance with the common-rail fuel-injection system constructed as described above, the mean pressure after fuel injection in the common rail is given by averaging the pressure values of the common-rail pressure that is pulsating after the pressure drop caused by the fuel injection. The mean pressure after fuel injection is considered to be an approximation nearly the estimate to which the pulsation in the common-rail pressure attenuates, even if the pressure surge takes place in the common-rail pressure due to the pressure drop caused by any fuel injection and the resultant pressure surge experiences much variance in its waveform by the reasons described above. The amount of pressure drop resulting from the fuel injection may be derived with accuracy and stability from the deviation between the mean pressure after injection and the pressure before injection in the common rail-pressure prior to the pressure drop owing to the fuel injection.

In an aspect of the present invention, a common-rail fuel-injection system is disclosed, wherein the control unit outputs a command signal to actuate the injector in accordance with the injection factors, and derives the pressure before fuel injection from values of the common-rail pressure sampled during a time interval between a timing the command pulse starts and a later timing the common-rail pressure drops due to the fuel injection.

In another aspect of the present invention, a common-rail fuel-injection system is disclosed, wherein the control unit finds an extreme value in the common-rail pressure, where a derivative of the common-rail pressure becomes zero after the beginning of the pressure drop in the common-rail pressure, and calculates the mean pressure after fuel injection by averaging the extreme values, which happen successively in the common-rail pressure. The common-rail pressure at the timing the derivatives thereof becomes zero is either maximum or minimum peak pressure and, therefore, the mean value of the extreme values may be considered to be the mean pressure after any fuel injection in the common-rail pressure.

In another aspect of the present invention, a common-rail fuel-injection system is disclosed, wherein the successive extreme values in the common-rail pressure are maximum and minimum instantaneous values that occur in either a first one cycle or early plural cycles of the pulsating pressure remaining in the common-rail. Since the one complete period of the pulsating common-rail pressure includes therein both the maximum and minimum extreme values, which occur alternately in the pulsation, averaging the successive maximum and minimum extreme values results in finding the mean pressure.

In a further another aspect of the present invention, a common-rail fuel-injection system is disclosed, wherein the control unit finds deviations of the extreme values in the common-rail pressure from the pressure before fuel injection, and considers a mean value of the deviations to be the amount of pressure drop. As an alternative, the amount of pressure drop may be obtained by a deviation in pressure between the pressure before injection and a mean value that has been found from the extreme values in the common-rail pressure. Moreover, the same result as in the ways described above will be also given by averaging an integral of deviations in pressure between the pressure before injection and extreme values in the common-rail pressure.

In another aspect of the present invention, a common-rail fuel-injection system is disclosed, wherein the control unit finds a mean value of the amounts of pressure drop averaging the values of the amounts of pressure drop that are successively calculated about each injector, and considers the mean value to be the amount of pressure drop in the common-rail pressure.

In another aspect of the present invention, a common-rail fuel-injection system is disclosed, wherein the control unit outputs a command pulse to actuate the injector in accordance with the injection factors, with detecting whether or not the engine operates under a steady states, and acquires a correlative data between the command pulse and the amount of fuel injected through a learning process that is executed, when the engine operates under steady condition, as to the command pulse output and the actual amount of fuel injected, which is found based on the amount of pressure drop in the common-rail pressure resulting from the fuel injection out of the injector actuated with the command pulse. The actual amount of fuel injected often undergoes a variance caused by aging in the injection characteristics of the individual injectors. To cope with this problem, the control unit measures whether the engine operates under steady operating condition to make it possible to acquire the correlative data between the command pulse and actual amount of fuel injected through the learning process when the engine is under the steady operating condition in which there is kept stable the relation of the command pulse with the amount of fuel injected.

In another aspect of the present invention, a common-rail fuel-injection system is disclosed, wherein the control unit acquires another correlative data through the learning process, the another correlative data being provided when the amount of fuel injected is a minute amount of fuel that is not more than a preselected amount of fuel injected. When the fuel injected is very minute in quantity, the amount of fuel injected is considered largely variant every injector and according to aging of the individual injectors to make the feedback control almost impossible.

Thus, the correlative data between the command pulse width and the amount of fuel injected is corrected through the learning, which is executed to find the actual amount of fuel injected, depending on both the command pulse width when the engine is under the steady operating condition and the amount of pressure drop caused in the common rail in response to the pulse width.

In a further another aspect of the present invention, a common-rail fuel-injection system is disclosed, wherein the control unit finds an injection factor of a major injection and another injection factor of a pilot injection to inject the minute amount of fuel prior to the major injection, and regulates the minute amount of fuel injected in the pilot injection with an open-loop control system on the basis of the correlative data acquired through the learning process. As the major injection is accomplished just after the pilot injection, it often become difficult to calculate the amount of pressure drop resulting from only the pilot injection. This makes it tough to carry out the feedback control to find the amount of fuel to be injected in the pilot injection on the basis of the deviation from the actual amount of fuel injected, which might be given by the amount of pressure drop in the common-rail pressure due to the pilot invention. In contrast, the amount of fuel injected in the pilot injection may be governed with the open-loop control, depending on the correlative data found through the learning.

In another aspect of the present invention, a common-rail fuel-injection system is disclosed, wherein the common rail is applied with the fuel forced with pumping action of a fuel-supply plunger pump in response to the fuel injection out of the injector, and the control unit governs, depending on the injection factor, an amount of fuel delivered out of the fuel-supply plunger pump. Controlling the amount of fuel delivered out of the high-pressure fuel-supply pump helps restore the common-rail pressure that has fallen owing to the fuel injection, or also change the common-rail pressure to an arbitrary pressure level required according to the engine operating conditions.

In the conventional common-rail fuel-injection systems, the sudden pressure drop caused in the common-rail pressure owing to the fuel injection leads to the pressure surge or oil hammer in the common rail, which keeps on pulsating for a length of time after the end of the fuel injection. The pulsation experiences much variance in its waveform, depending on the mechanical characteristics and aging of the individual injectors, the position and/or arrangement of the individual injectors along the common rail, and the pressure average of the common-rail pressure and the engine operating conditions. This makes it impossible to measure precisely the amount of pressure drop in the common-rail pressure. After all, the scattering arises in the amount of fuel injected every injector, so that no desired amount of fuel injected is ensured for each injection, thereby causing the variance in combustion for each cylinder, with resulting in major causes to make worse the vibration, noise and exhaust performance of engines.

In contrast, the common-rail fuel-injection system of the present invention is so constructed as to calculate a mean pressure after injection of the common-rail pressure remaining pulsating after the pressure drop due to the fuel injection. The mean pressure may be considered to be approximating nearly an estimate to which the pulsation in the common-rail pressure attenuates. Thus, the deviation of the mean pressure after injection from the pressure before injection may be recognized reasonably and steadily to be the amount of pressure drop caused by the fuel injection. The amount of fuel reasonable to be injected actually may be derived from the deviation in pressure on the basis of an injection map, which has been previously prepared. Thus, the actual amount of fuel injected is feedback controlled to come in matching with the desired amount of fuel to be injected. Especially, no variance in the amount of fuel injected every cylinder occurs in even when the engine is running at low-speed revolutions such as idling, thereby reducing uncomfortable vibration and noise, fuel consumption of the engine and further improving the exhaust-control performance. In addition, when the feedback control of the amount of fuel injected is troublesome because the fuel injected is minute in quantity as in the fuel injection under idling of engine or in the pilot injection carried out prior to the major injection, the minute amount of fuel injected may be regulated through an open-loop control system on the basis of the correlative data between the actual amount of fuel injected and the command pulse width, which is acquired through the learning process depending on the amount of pressure drop in the common rail found by averaging as described above.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DETAILED DESCRIPTION OF THE PREFERRED EMBODIMENTS

Preferred embodiments of a common-rail fuel-injection system according to the present invention will be explained in detail hereinafter with reference to the accompanying drawings.

Figure 17:
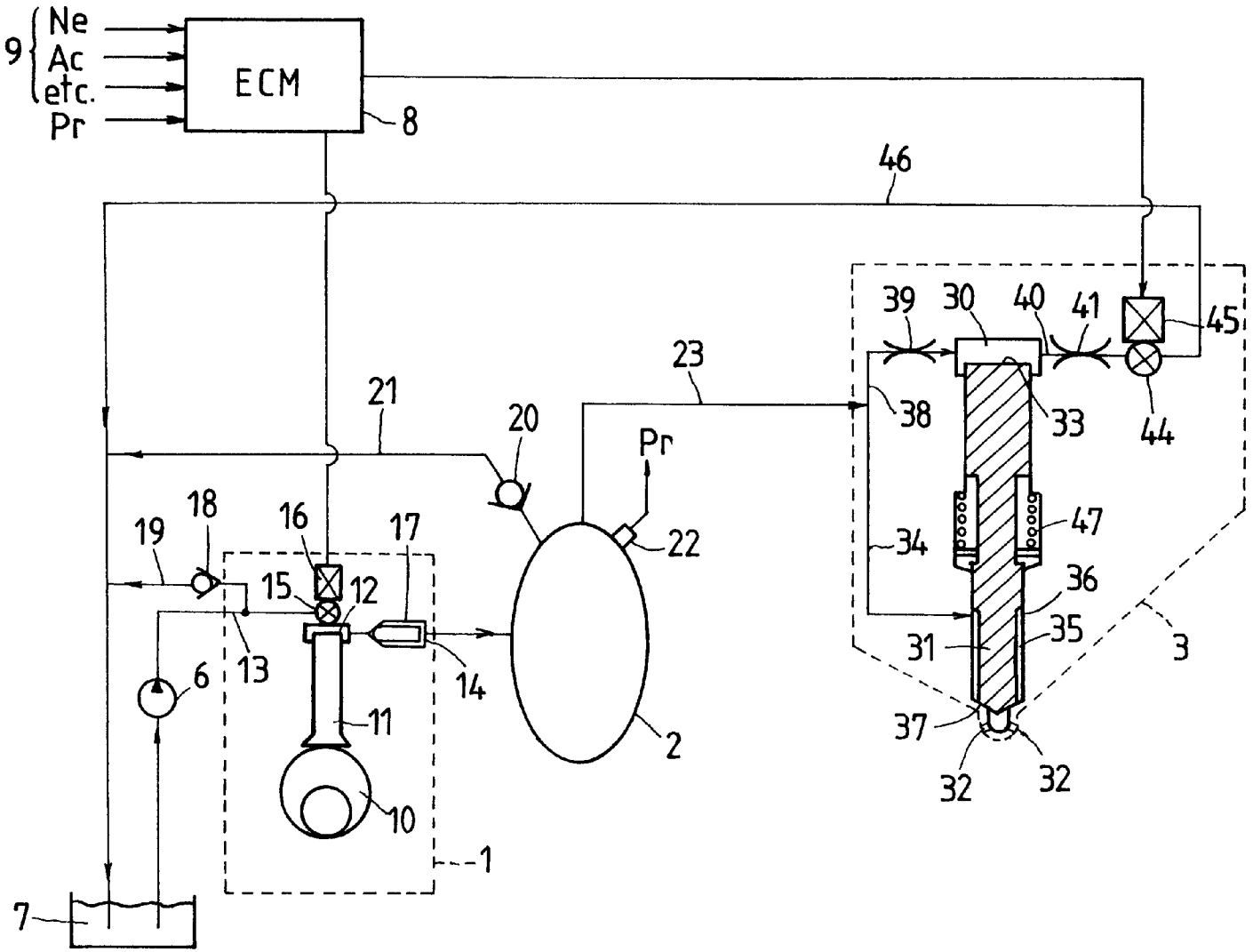
FIG. 17 (PRIOR ART)
FIG. 17 is a general schematic view, partly in section, illustrating a conventional common-rail fuel-injection system.

Major components in the common-rail fuel-injection system according to the present invention, such as injectors, high-pressure fuel-supply pump, common rail, and so on are the same as previously described with reference to FIG. 17, so that the previous description will be applicable hereinafter.

Figure 1:
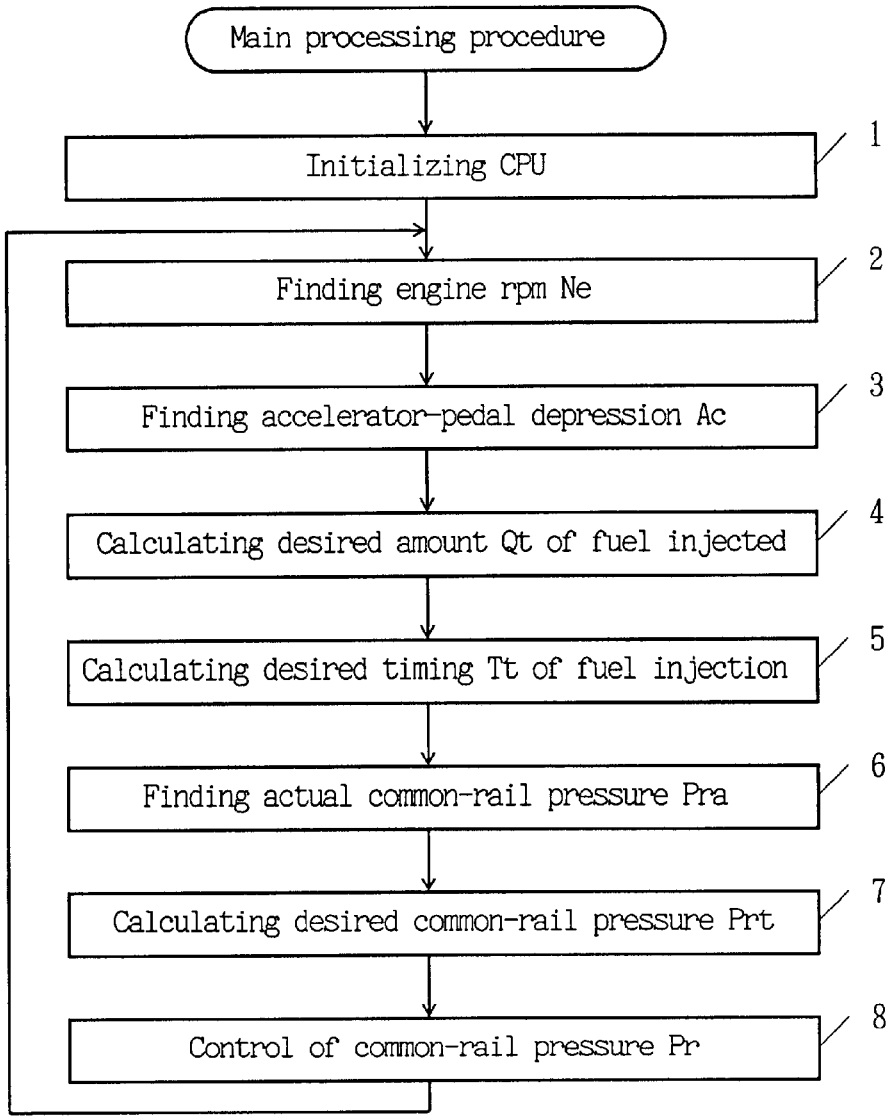
FIG. 1 is a flowchart explaining a main processing procedure executed in a fuel injection in a common-rail fuel-injection system in accordance with the present invention.

In a common-rail fuel-injection system of the present invention, the main processing procedure for fuel injection, or basic decision-making processes such as finding the engine rpm, fundamental amount of fuel injected, and so on is executed in accordance with a flowchart illustrated in FIG. 1. Firstly, a CUP installed in a control unit is initialized (Step 1). An engine rpm Ne and an accelerator pedal depression Ac are found, depending on signals reported from sensing means to monitor engine operating conditions (Steps 2 and 3). A desired amount Qt of fuel injected per cycle and a desired timing Tt of fuel injection are given, depending on the engine rpm Ne and accelerator pedal depression Ac found at the steps 2 and 3 (Steps 4 and 5). An actual common-rail pressure Pra is found based upon a signal reported from a pressure detector installed in the common rail (Step 6). A desired common-rail pressure Prt available for the high injection pressure is obtained on the basis of both the desired amount Qt of fuel injected and the engine rpm Ne (Step 7). The common-rail pressure Pr is controlled to render the actual common-rail pressure Pra coincide with the desired common-rail pressure Prt (Step 8).

Figure 2:
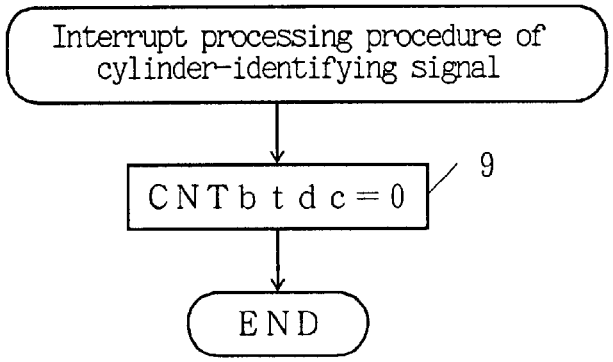
FIG. 2 is a flowchart explaining an interrupt processing procedure of a cylinder-identifying signal in the main processing procedure shown in FIG. 1.

If a cylinder-identifying signal REF is recognized in the process of the flowchart in FIG. 1, an interrupt processing procedure of a cylinder-identifying signal in the main processing procedure is executed according to the flowchart shown in FIG. 2. When any cylinder, for example, cylinder 1 comes into the order of injection, a count value CNTbtdc of cylinder-numbering identification is reset to a 0 state at the instant a cylinder-identifying signal REF is sensed at a preselected crank angle just before top dead center, contracted to TDC hereinafter (Step 9). Assuming that the cylinders in an engine is numbered from #1 to #4, the firing order of this engine is #1- #3- #4- #2. The count value CNTbtdc of cylinder-numbering identification has any number of 1, 2, 3 and 4, which correspond to #1, #2, #3 and #4, respectively.

Figure 3:
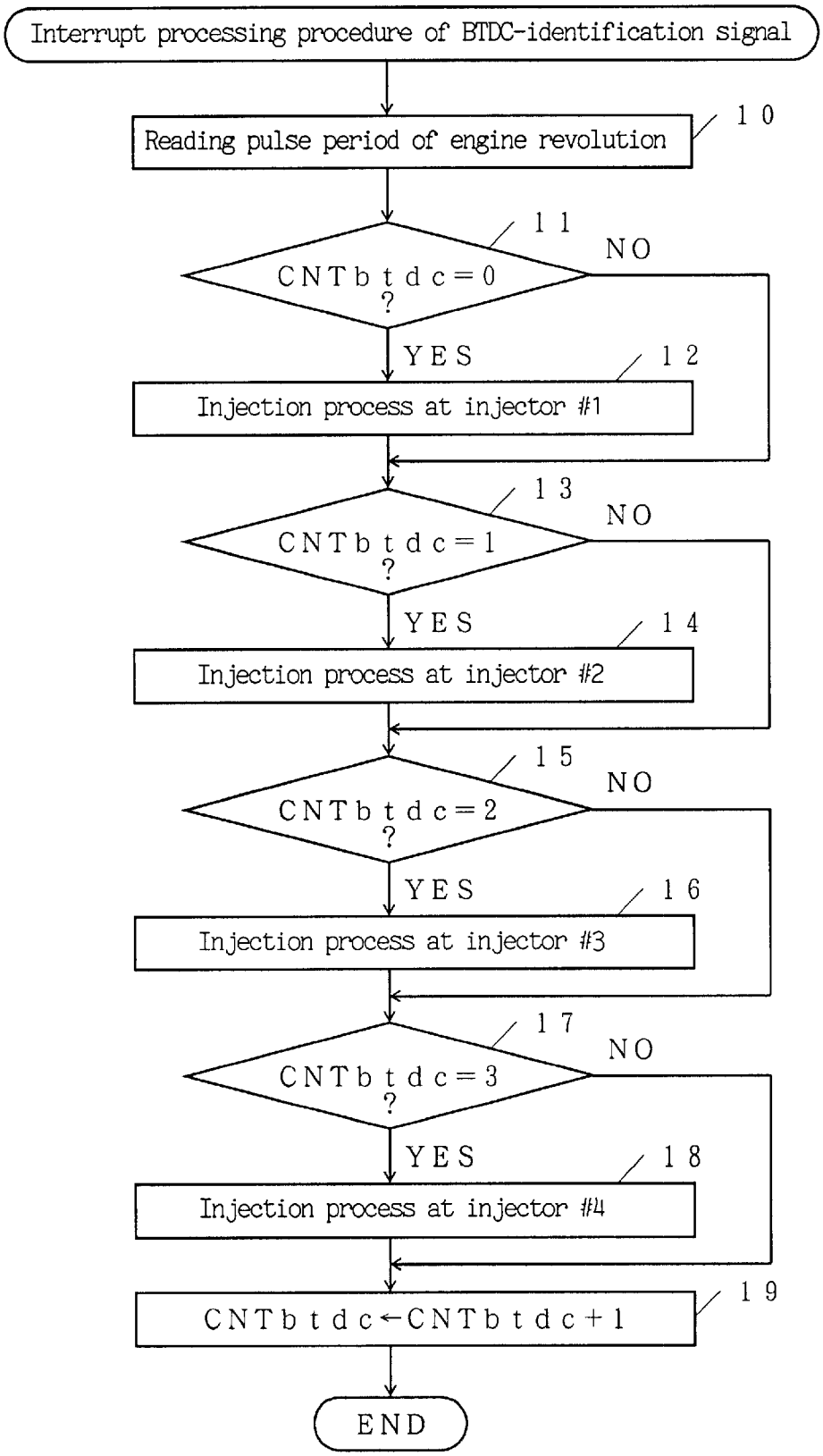
FIG. 3 is a flowchart explaining an interrupt processing procedure of a bottom dead center-identifying signal in the main processing procedure shown in FIG. 1.

When a signal reporting the instant a piston is reaching just before TDC, contracted hereinafter to BTDC-identification signal, is sensed for each cylinder in the process of the main processing procedure in FIG. 1, the interrupt processing procedure of the BTDC-identification signal is executed according to the flowchart in FIG. 3 to carry out fuel-injection process for each of the injectors, which are installed in the cylinder, each to each cylinder. A pulse period of engine revolution is read in, which is sensed in accordance with crankshaft rotation (Step 10). Whether the count value CNTbtdc of cylinder-numbering identification is 0 is determined (Step 11). When the count value CNTbtdc is 0, the fuel injection process is carried out at the injector #1, which is installed in the cylinder #1 in the cylinder numbering and firing order (Step 12). Whether the count value CNTbtdc, as with the above, is any of 1, 2 and 3 is determined in sequence (Steps 13, 15 and 17). If the result is YES, the fuel-injection process is carried out as to any injector #2, #3 and #4 along the firing order (Steps 14, 16 and 18). The count value CNTbtdc increases in number by 1 every one execution of the interrupt processing procedure of the BTDC-identification signal (Step 19). With the interrupt of the BTDC-identification signal, thus, the fuel-injection process is carried out every injector in sequence in accordance with the firing order.

Figure 4:
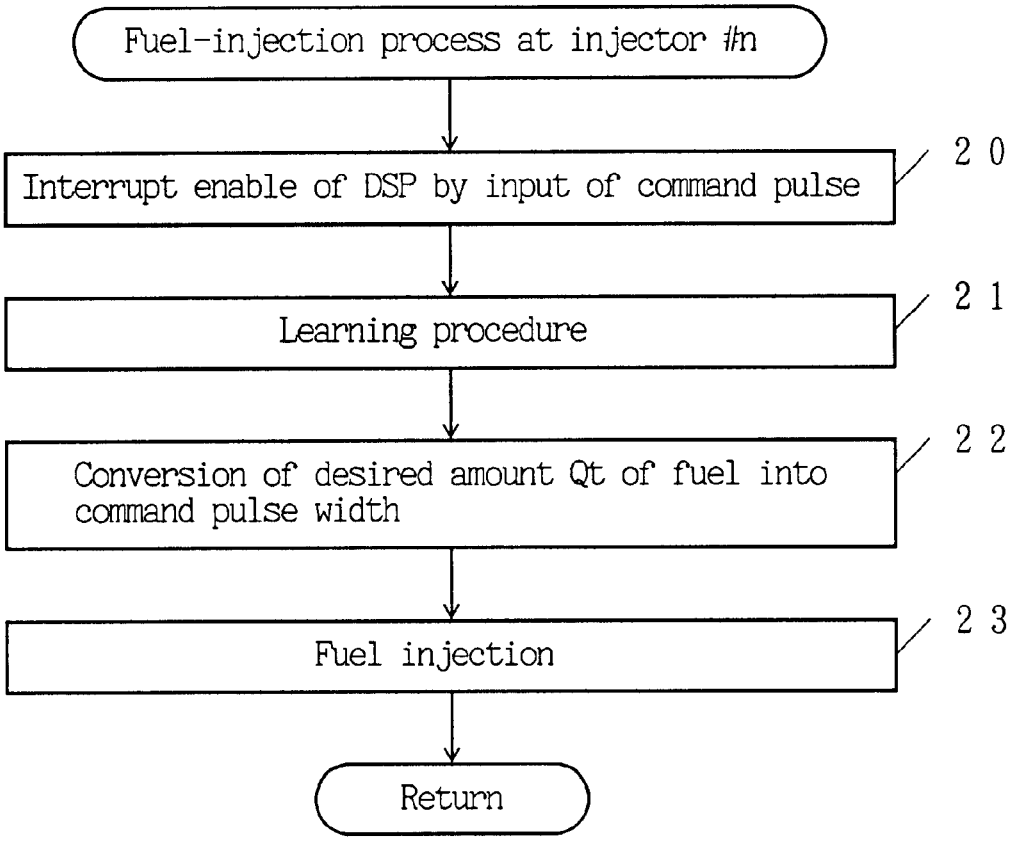
FIG. 4 is a flowchart explaining a procedure at each injector to be executed in the interrupt processing procedure of a cylinder-identifying signal in FIG. 3.

The fuel-injection process carried out in the interrupt of the BTDC-identification signal in FIG. 3 will be described in detail with reference to FIG. 4. The interrupt of the DSP is made enabled by the input of a command pulse (Step 20). A learning procedure is carried out, which will be explained below (Step 21). A command pulse width Pw in keeping with a desired amount Qt of fuel injected is derived from a mapped data of correlation between the command pulse width Pw and the amount of fuel injected, which data has been acquired through the learning at the step 21 (Step 22). The resultant command pulse width is read in any register in the CPU of the control unit to thereby accomplish a real fuel injection (Step 23).

The learning procedure executed in each fuel-injection process every injector in FIG. 4 will be described in detail with reference to FIG. 5. Most diesel engines, especially when running at low speeds or at part loads such as idling, are apt to cause combustion noise due to ignition lag. A version of fuel-injection system to effectively reduce combustion noise has been known, in which the desired amount of fuel injected per one combustion cycle is divided into a major injection part and a pilot injection part of minute amount, which is charged in advance of the major injection. To derive in advance the amount of fuel to be injected from the amount of pressure drop in the common-rail pressure, it is necessary to gather samples of data on the common-rail pressure for a preselected length of time. Such data samplings on the common-rail pressure have to be completed prior to every major injection because the major injection results in a further drop in the common-rail pressure that has already fallen due to the pilot injection. Nevertheless, when an interval of time between the pilot and major injections is too short to acquire sufficient sampling data, it is very hard to derive the amount of fuel to be injected every fuel injection from the amount of pressure drop in the common-rail pressure. To cope with this, the fuel-injection system of the present invention proposes to inject a minute amount of fuel on the condition of a shot of injection per a cylinder, thereby preparing a map, shown in FIG. 15, of correlation between minute amounts of fuel injected and command pulse widths through the learning. The map thus prepared is available to find the command pulse width required for the injection of a desired minute amount of fuel at the pilot injection. The condition of a shot of injection per a cylinder will be explained in accordance with a learning prerequisite identification procedure shown in FIG. 6.

Figure 15:
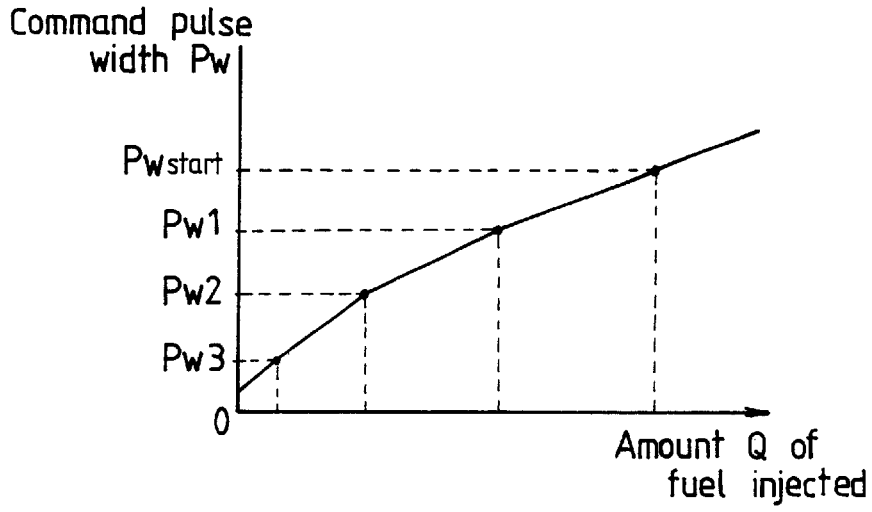
FIG. 15 is a graphic representation explaining the coordinates of an amount Q of fuel injected and a command pulse width Pw.

The learning procedure firstly begins with the learning prerequisite identification procedure (Step 30). Whether the prerequisite to begin the learning is satisfied is identified. If the result is YES, the learning is initiated (Step 31). A command pulse width Pw1 is set for first learning (Step 32). The command pulse width Pw1, as seen from FIG. 15, is a value that is given by dividing in equal parts a pulse width ranging from 0: Pw=0 to a pulse width Pwstart for the major injection during the idling operation. An amount of pressure drop ΔPr caused in the common-rail pressure due to the fuel injection is calculated in the DSP procedure 4 described below, and then read in (Step 33). The amount of pressure drop stored at the step 33 is made averaged (Step 34). The averaging procedure at the step 34, as opposed to the averaging procedure in terms of time executed in the DSP, is the averaging procedure in which the amount of pressure drop ΔPr calculated at the DSP: a value obtained by subtracting the mean value Prave of sampling data from a pressure Pr0 just before any fuel injection is made averaged in terms of injection shot per each cylinder. The averaging procedure at the step 34 is required in case wherethere is the considerable scattering or variance in the observed amount of pressure drop ΔPr and hence, no averaging procedure may be necessary if there is little variance.

Figure 14:
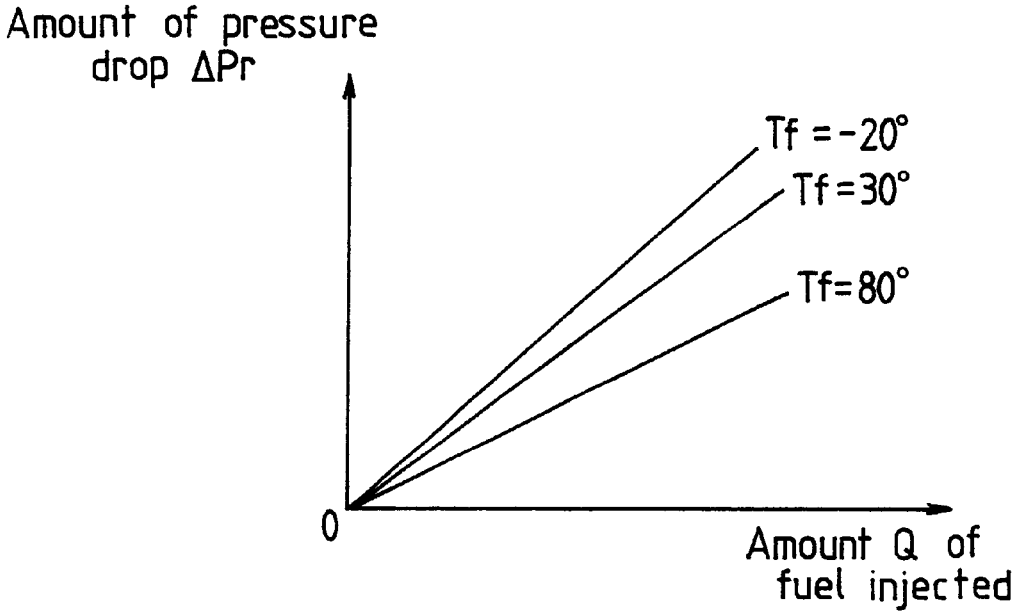
FIG. 14 is a graphic representation explaining the coordinates of an amount Q of fuel injected and an amount of pressure drop ΔPr in the common-rail pressure in term of an auxiliary variable: fuel temperature Tf.

FIG. 14 is a graphic representation explaining the coordinates of an amount Q of fuel injected and an amount of pressure drop ΔPr in the common-rail pressure in term of an auxiliary variable of fuel temperature Tf. The amount Q of fuel injected is in general directly proportional to the amount of pressure drop ΔPr and their proportionality constant becomes large as the fuel temperature Tf decreases. According to FIG. 14, the anticipated amount Q of fuel injected is given in correspondence with any amount of pressure drop ΔPr (Step 35). The graph in FIG. 14 illustrates the results of experiments carried out under atmospheric condition stable in temperature, pressure and so on. A memory prepared previously is stored with the relation between the command pulse width Pw and the amount Q of fuel injected (Step 36). With nonvolatile memories, the injection map may remain still after the engine operation has ceased. Following the completion of the learning with the first command pulse width Pw1, the learning is further executed on another command pulse width Pw (Step 37). The command pulse width Pw for each learning is defined by dividing in equal parts, for example, in four equal parts as shown in FIG. 15, a pulse width ranging from Pw=0 to a pulse width Pws.

Following the Pw1, the Pw2 and Pw3 are set in sequence and finally whether the Pw3 for the last learning takes place is identified (Step 38). When the learning on the command pulse width Pw3 terminates, the command pulse width Pw is reset to the 0 state to complete the learning (Step 39). The correlation between the amount Q of fuel injected and the command pulse width Pw given according to the procedure described above is shown in FIG. 15 and also stored in the control unit 8 in the form of the injection map.

Figure 5:
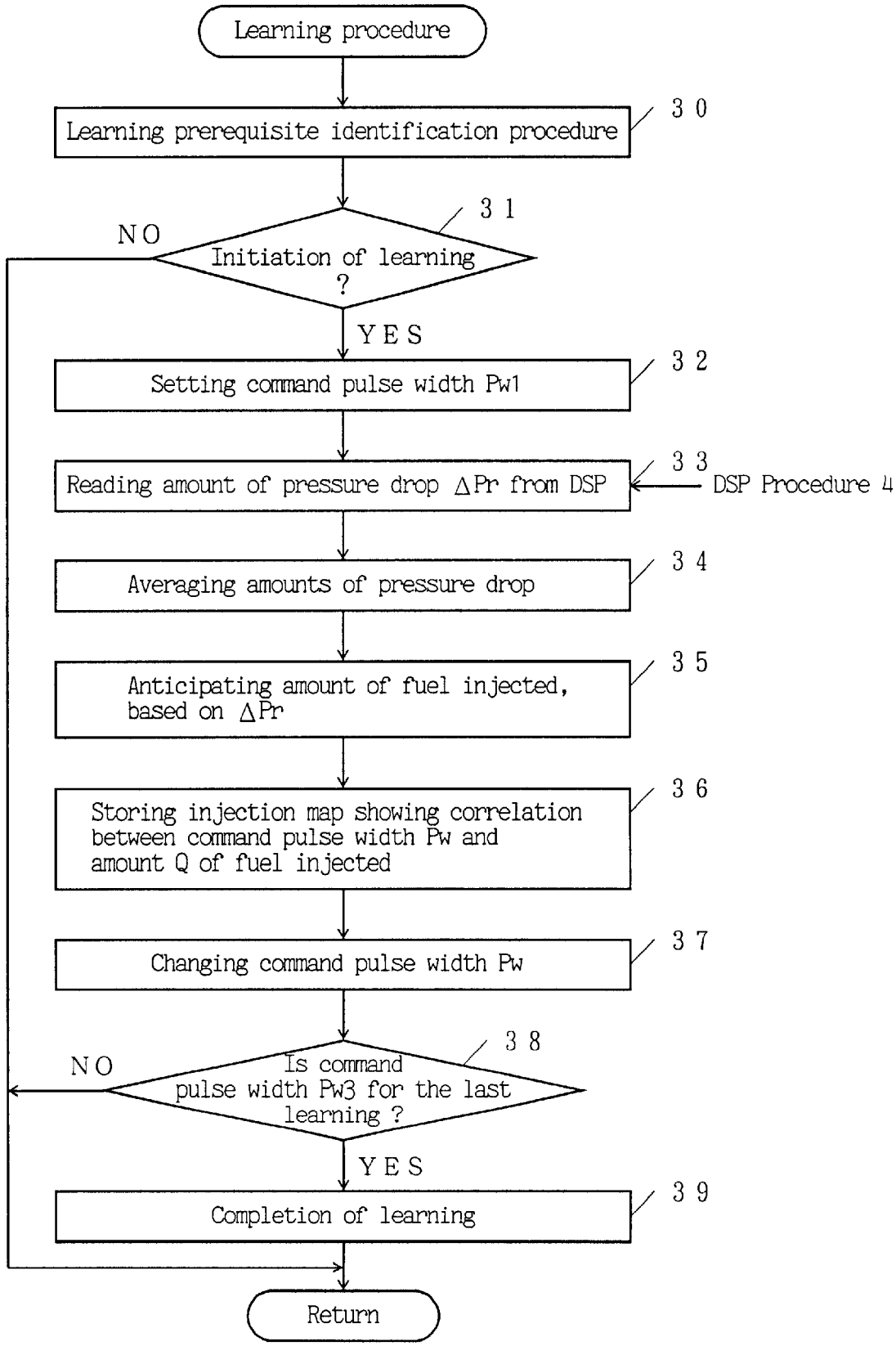
FIG. 5 is a flowchart explaining a learning procedure executed in the fuel-injection process shown in FIG. 4.
Figure 6:
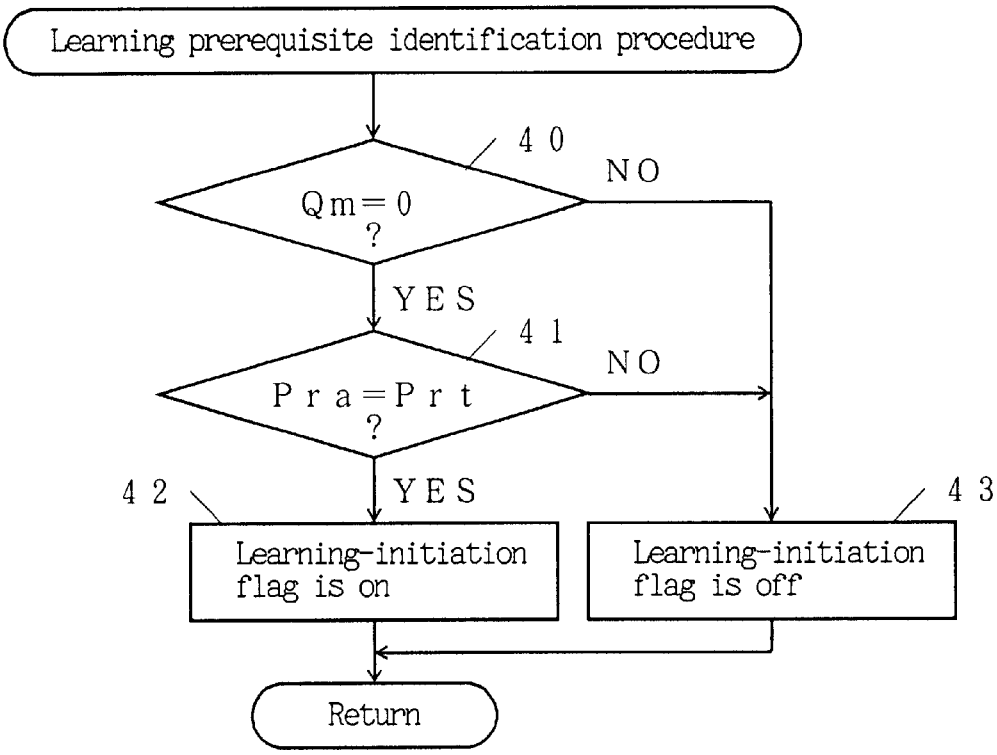
FIG. 6 is a flowchart explaining a learning prerequisite identification procedure executed in the learning procedure in FIG. 5.

The learning prerequisite identification procedure in the step 30 in the learning procedure in FIG. 5 is executed in accordance with the flowchart in FIG. 6. The learning prerequisite identification procedure is to identify whether the learning prerequisite is satisfied or not. Identifying the learning prerequisite is initiated with whether the engine operates on stable or steady operating condition or not. A typical example of the events allowing the engine to operate on the steady condition is the idling at which the engine runs when the accelerator pedal is fully released and there is no load on the engine. The actual common-rail pressure at the event described just above is adjusted to a pressure equal to a desired common-rail pressure at idling. After the confirmation of no amount Qm of fuel injected at the major injection at the step 40, if the actual common-rail pressure Pra is identified to be equal with the desired common-rail pressure Prt at idling operation, which is found on the desired common-rail pressure map, a learning-initiation flag is on (Step 42). If any one of the learning requisites is unsatisfied, the learning-initiation flag is off to set aside the learning procedure (Step 43). However, no step 43 may be necessary. It is moreover to be noted that no learning may be always necessary, even though both the prerequisites at the steps 40 and 41 are satisfied. Considering that the principal object of control system of the present invention is to compensate for the scattering of the amount of fuel injected, which might result from the variance in mechanical characteristics and aging of the individual injectors, the learning procedure may be executed either once at any timing during the engine operation ranging from starting to coming to a standstill or every preselected interval of time according to the calendar installed in the CPU. An amount Qm of fuel injected at the major injection appreciated from the pressure drop caused by the major injection at idling operation, though set aside the learning prerequisites, is rendered the upper limitation in the injection map of the relation between the command pulse width and the amount of fuel injected to calculate the amount Qp of fuel injected in the pilot injection. On practical engine operation, there may sometimes arise a significant deviation out of the learning prerequisites before the completion of learning. In such case, it is allowed to suspend the storing of the injection map midway through the learning procedure and resume the storing of the injection map for the remaining learning command pulse widths whenever the learning prerequisites are satisfied again. The engine prior to shipment operates on learning prerequisites from initiation to end of learning, thereby storing therein the acquired results about the correlation between the command pulse width and the amount of fuel injected.

Figure 7:
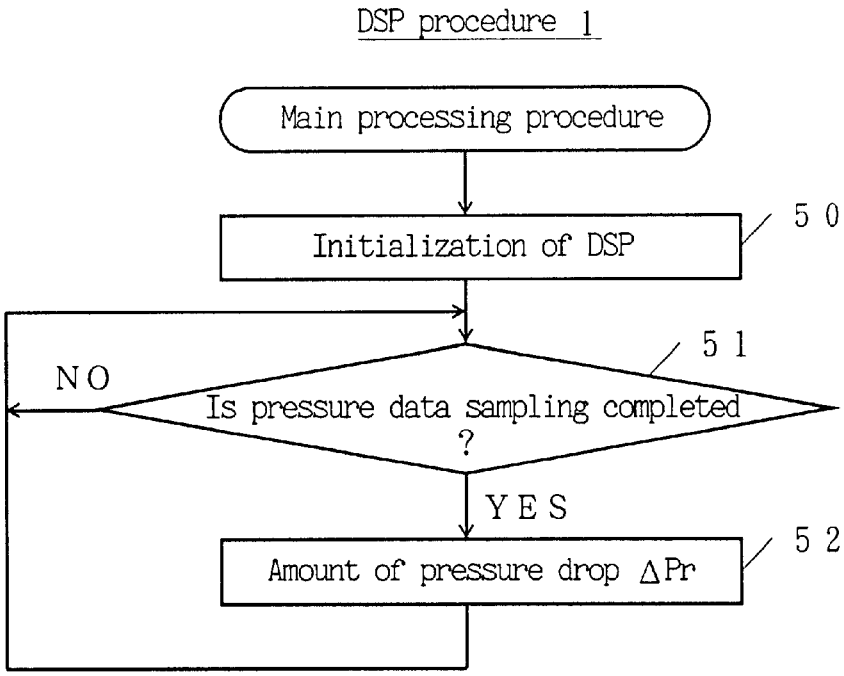
FIG. 7 is a flowchart explaining a DSP procedure 1 executing the main processing procedure to find an amount of pressure drop owing to any fuel injection.
Figure 13:
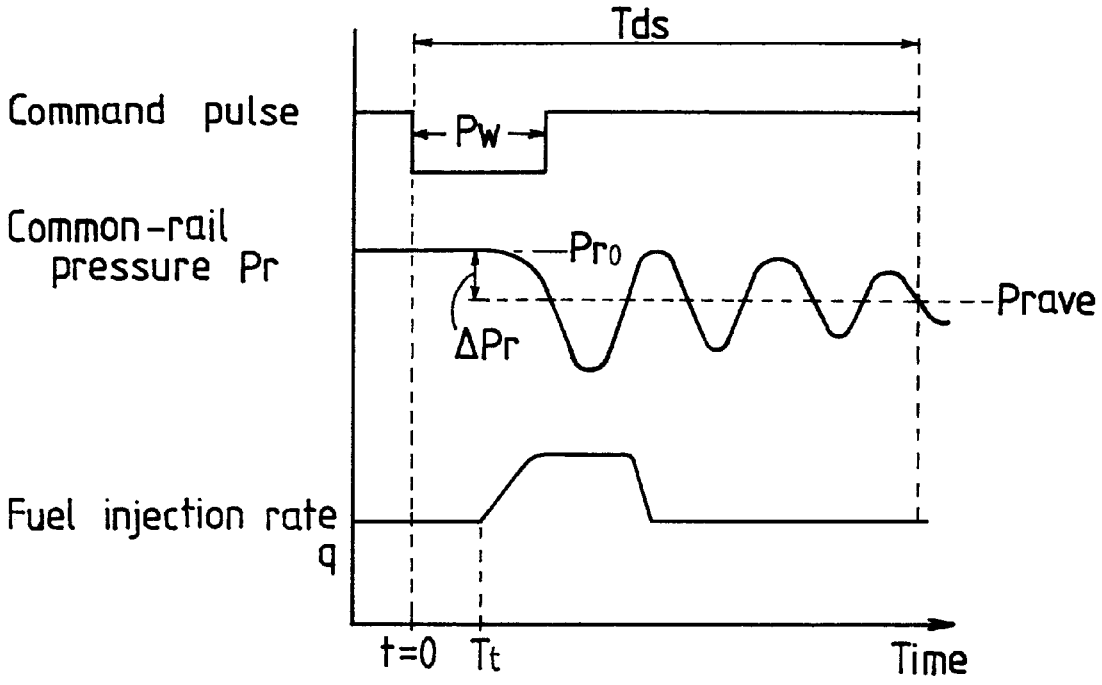
FIG. 13 is a composite chart showing a timing relation of several variables: command pulse, fuel injection rate and common-rail pressure to explain how to find the amount of pressure drop in the common rail in the common-rail fuel-injection system in accordance with the present invention.

A DSP procedure to calculate the amount of pressure drop ΔPr caused by any fuel injection is carried out in accordance with a DSP procedure 1 executing the main processing procedure, which is explained in a flowchart in FIG. 7. The DSP procedure 1 starts with the initialization of the DSP (Step 50). Whether the data sampling of the common-rail pressure is completed is identified (Step 51). As shown in FIG. 13, the data about the common-rail pressure is gathered along a length of time, or a data-sampling period Tds, ranging from a timing the command pulse starts to a timing the pulsation in the common-rail pressure Pr decays sufficiently to a preselected frequency. If the data sampling is not yet completed, the sampling is continued still over the data-sampling period Tds. On completion of the data sampling, the amount of pressure drop ΔPr in the common-rail pressure Pr is calculated (Step 52).

Figure 8:
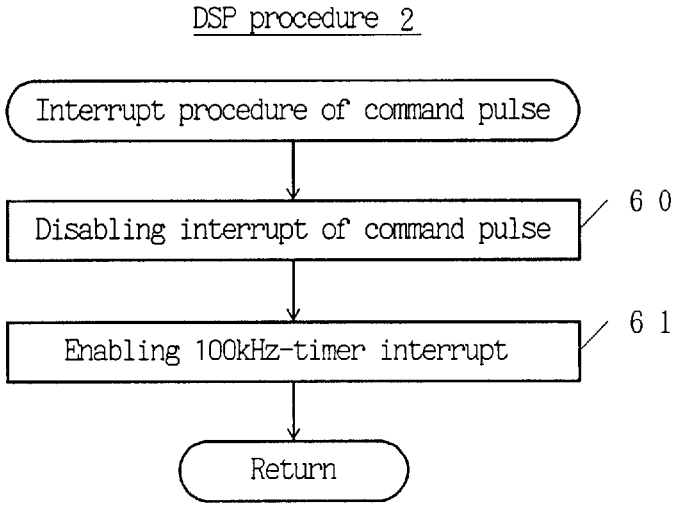
FIG. 8 is a flowchart explaining a DSP procedure 2 executing an interrupt processing procedure of a command pulse in the process of the main processing procedure in FIG. 7.

A DSP procedure 2 for an interrupt processing procedure of a command pulse is executed according to a flowchart shown in FIG. 8. On sensing the interrupt of any command pulse, the interrupt of the command pulse is disabled to inhibit the main processing procedure from a further interrupt of other command pulse (Step 60). After the lapse of any data sampling period for the preselected periods, for example, 100 kHz in the present case, a 100 kHz-timer interrupt is enabled (Step 61).

Figure 9:
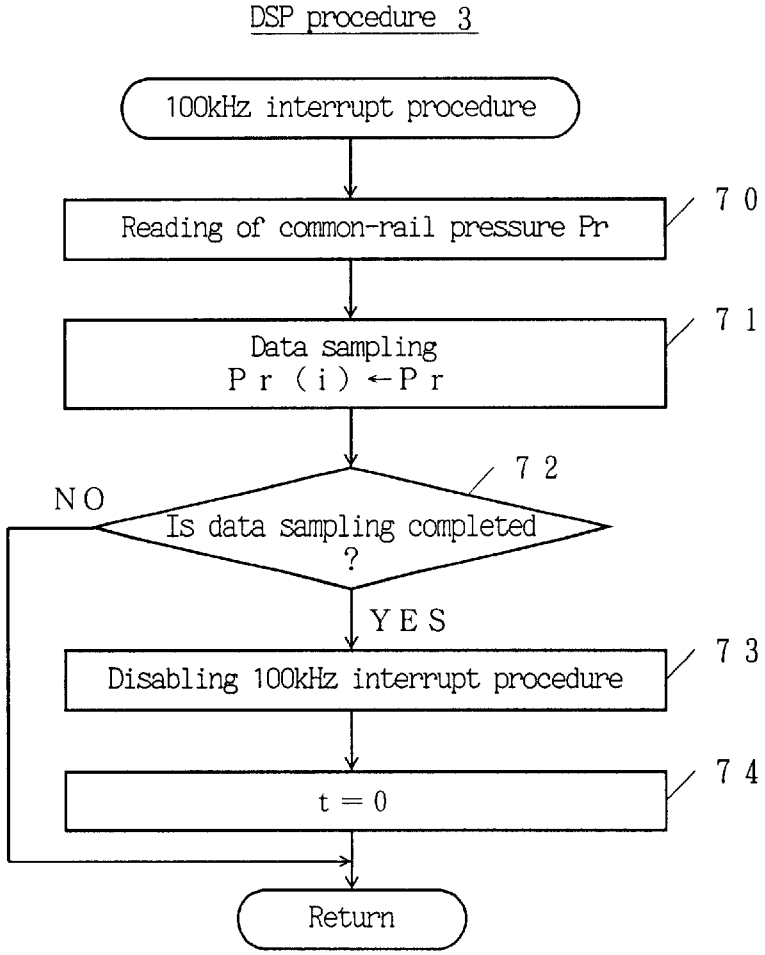
FIG. 9 is a flowchart explaining a DSP procedure 3 executing an interrupt processing procedure of 100 kHz in the process of the DSP procedure 3 in FIG. 8.

A DSP procedure 3 for an interrupt processing procedure of 100 kHz is executed in accordance with a flowchart shown in FIG. 9. Storing the common-rail pressure Pr starts by the action of a timer actuated at 100 kNz and continues for a data-sampling period of the preselected periods (Step 70). The stored common-rail pressure is a value Pr(i) sampled during an interval of time $t_i$, which has elapsed after the command pulse (Step 71). Whether the data sampling is completed is identified (Step 72). If the data sampling is not yet completed, next 100 kHz interrupt is processed to execute a DSP procedure 3. On completion of the data sampling, the 100 kHz interrupt is inhibited (Step 73) while the time t is initialized or reset to 0 (Step 74).

Figure 10:
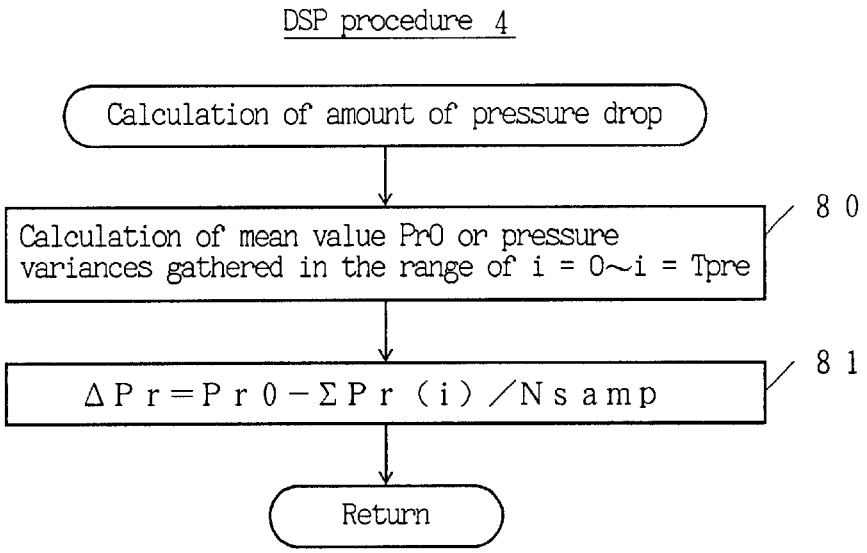
FIG. 10 is a flowchart explaining a DSP procedure 4 executing the main processing procedure in FIG. 7 to find an amount of pressure drop owing to any fuel injection.

A DSP procedure 4 to calculate the amount of the pressure drop ΔPr in the common-rail pressure owing to any fuel injection is executed according to a flowchart shown in FIG. 10. A common-rail pressure Pr0 just before any injection is calculated by averaging the data gathered for a preselected interval ($t_i$=0, where i is 0, ~$t_i$=Tpre) of time, which ranges from just after the interrupt of the command pulse, which takes place at a timing the command pulse beings, that is, at a timing the command pulse starts to rise or fall, to just before another timing the pressure drop occurs in the common-rail pressure (Step 80). A mean pressure Prave after injection is derived by dividing an integral of the value P(i) in the common-rail pressure, sampled during an interval of time $t_i$, by a population N of sampling. Subtracting the mean pressure Prave from the pressure Pr0 just before any injection given at the step 80 results in obtaining the amount of pressure drop ΔPr in the common-rail pressure (Step 81). The formula denoted at the step 81 may be expressed by a modified equation: $\Delta Pr=[\Sigma(Pr0-Pr(i))]/Nsamp$. That is to say, a difference between the pressure Pr0 just before injection and the value P(i) in the common-rail pressure is first obtained every value P(i) in the common-rail pressure, sampled during an interval of time $t_i$, which has elapsed after the command pulse. Then, the amount of pressure drop ΔPr in the common-rail pressure is given by dividing the sum of the differences by the population N of sampling.

Referring next to FIG. 13, there is shown a composite chart of variations along the lapse of time of command pulse or injection command signal, fuel injection rate q and common-rail pressure Pr. As will be known from FIG. 13, since a pressure surge or oil hammer taking place in the injector 3 due to the fuel injection propagates repeatedly through the associated injection line 23 extending between the injector 3 and the common rail 2, the pulsation occurring in the common-rail pressure Pr due to any injection remains for a preselected interval of time with damping gradually. Thus, no net amount of pressure drop in the common-rail pressure may be given immediately after any fuel injection.

According to the present invention, it is proposed to gather a population of the values of Pr(i) sampled in the common-rail pressure Pr and find the arithmetic mean value of the values of Pr(i). That is to say, the mean pressure Prave after injection is found by dividing an integral of the values of Pr(i) by a population of samples Nsamp. Thus, the mean pressure Prave after injection may be considered the net common-rail pressure after the pulsation has decayed sufficiently. Subtracting the mean pressure Prave after injection from the pressure prior to any injection results in obtaining the net amount of pressure drop ΔPr in the common-rail pressure. The amount Q of fuel injected correspondingly to the net amount of pressure drop ΔPr may be anticipated, based on the injection map obtained experimentally to provide previously the correlation between the amount of pressure drop and the amount of fuel injected.

Figure 11:
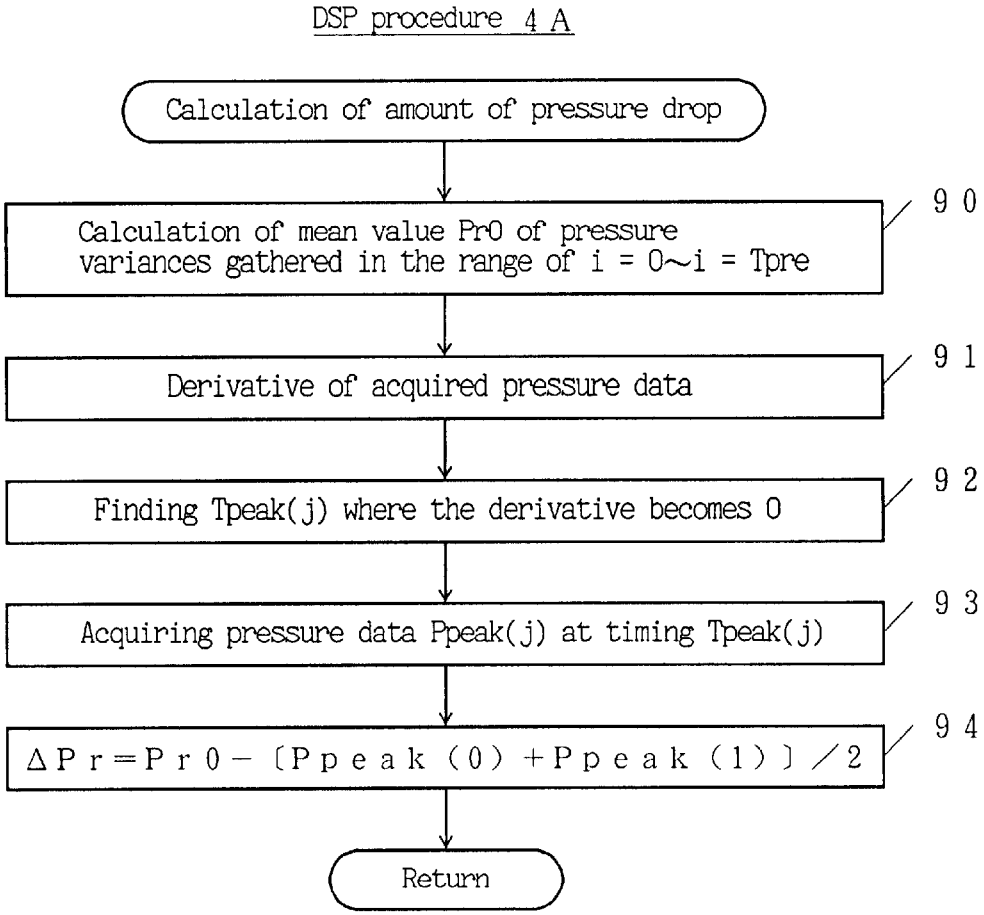
FIG. 11 is a flowchart explaining another DSP procedure 4A executed in place of the DSP procedure 4 to find an amount of pressure drop during one complete period.

Although but the DSP procedure 4 averages the data about the common-rail pressure Pr gathered along the data-sampling period Tds, the interval of time during which the sampling data of common-rail pressure to be averaged are gathered may be replaced with an alternative interval of time, which ranges from just after pressure drop to an integral multiple of the period of pulsation in pressure. The alternative interval of time corresponding to an integral multiple of the period of pressure pulsation is preferable because the deviation from the mean value may be removed out of consideration of the period of pressure pulsation. An example of the DSP procedure according to the alternative interval of time, as opposed to the procedure 4, is a DSP procedure 4A shown in a flowchart of FIG. 11, in which the amount of pressure drop is found, based on a first one complete period.

The DSP procedure 4A, in the same manner as the DSP procedure 4, starts with averaging the data gathered for a preselected interval ($t_i$=0~$t_i$=Tpre) of time, which ranges from just after the beginning of the command pulse, which takes place at a timing the command pulse starts to rise or fall, to just before another timing the pressure drop in the common-rail pressure occurs with a certain delay of time to calculate a common-rail pressure Pr0 just before any injection (Step 91). A value of the derivative of the acquired common-rail pressure is found, for example, by dividing a difference in value of any adjoining pressure data by an interval of time (Step 91). A timing Tpeak(j), where j=0, 1, 2, . . . , is found, wherein the value of the derivative of the common-rail pressure obtained at the step 90 becomes zero (Step 92).

Figure 16:
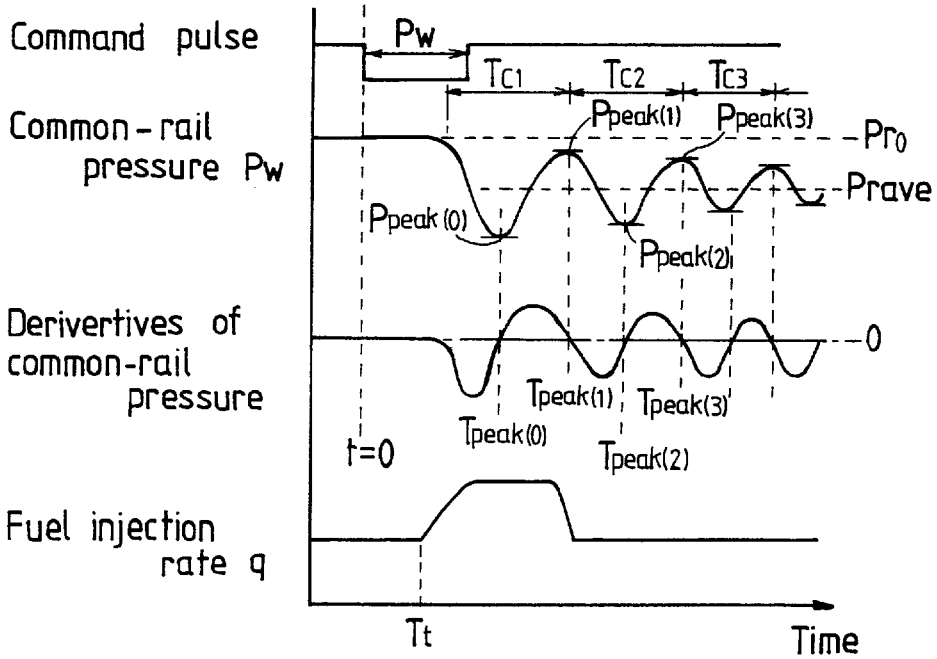
FIG. 16 is a composite chart showing a timing relation of several variables: command pulse, common-rail pressure and derivative thereof, and fuel injection rate to explain how to find the amount of pressure drop in the common rail in the common-rail fuel-injection system in accordance with the present invention.

Referring next to FIG. 16, there is shown a composite chart showing a timing relation of several variables: command pulse, common-rail pressure and derivative thereof, and fuel injection rate to explain how to find the amount of pressure drop in the common rail in the common-rail fuel-injection system. As will be seen from FIG. 16, a timing Tpeak(j) is a point where the value of the derivative of the common-rail pressure becomes 0. A pressure data Ppeak(j) of the common-rail pressure at the timing Tpeak(j) is acquired (Step 93). Any pressure data Ppeak(j) is either a maximum or a minimum instantaneous pressure in the common-rail pressure. Following the calculation of an amplitude for the first one complete cycle Tc1 of waveform in the common-rail pressure that has begun pulsating due to any fuel injection, the amount of pressure drop ΔPr in common-rail pressure is derived from the pressure before injection Pr0 according to the following formula $$\Delta Pr = Pr\mathbf{0} - [P\text{peak}(\mathbf{0}) + P\text{peak}(\mathbf{1})]/2 \text{ (Step } \mathbf{94}\text{)}.$$

The value P(j) of the common-rail pressure sampled at the timing the derivative of the common-rail pressure is 0 denotes any one of the maximum and minimum instantaneous pressures of the pulsating waveform in the common-rail pressure. The value Ppeak(j) would attenuate sufficiently if the considerable lapse of time were permitted after the fuel injection. Only waiting for sufficient attenuation, however, is inconsistent with reality. The average of the first minimum and maximum instantaneous pressures Ppeak(0), Ppeak(1) is a value closely approximating to the net common-rail pressure after the pressure drop to be considered the mean pressure Prave after fuel injection. Thus, the net amount of pressure drop ΔPr is given by subtracting the mean pressure Prave after injection from the pressure Pr0 before injection.

Figure 12:
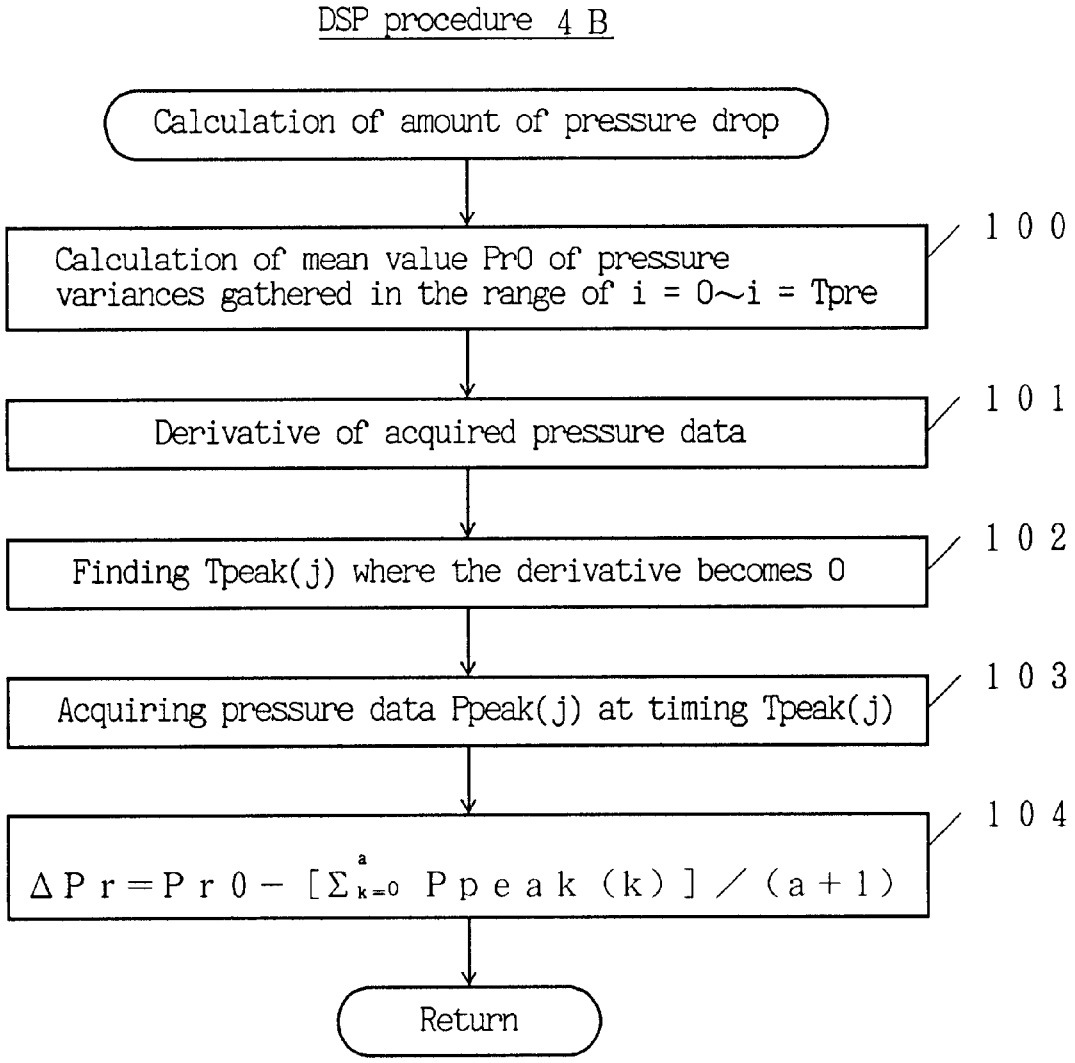
FIG. 12 is a flowchart explaining another DSP procedure 4B executed in place of the DSP procedure 4 to find an amount of pressure drop during some periods.

Although the DSP procedure 4A described just above finds an approximation of the net common-rail pressure after any pressure drop by averaging the first maximum and minimum pressures happening in the first one complete period Tc1 of the common-rail pressure that varies sinusoidally, the average of the maximum and minimum pressures occurring in at least twice integral multiple of the period of the pulsating common-rail pressure will result in making it possible to find the mean value that is much closer to the net common-rail pressure after injection than the approximation obtained in the DSP procedure 4A. Instead of the DSP procedure 4A, an alternative DSP procedure 4B shown in a flowchart of FIG. 12 may be employed, in which the amount of pressure drop is calculated on the basis of early some periods Tc1, Tc2, . . . The DSP procedure 4B executes the steps 100 to 103 in the same manner as the steps 90 to 93 in the former DSP procedure 4A. Assuming that the frequency of the period is x (≧1) and thus the positive odd numbers a is equal to 2x+1, or a=2x+1, the approximation of the net common-rail pressure after any pressure drop is found by averaging the maximum and minimum pressures taking place in some periods, as explained in the following formula. Then, the amount of pressure drop resulting from any injection is given at the step 104 by subtracting the averaged common-rail pressure from the common-rail pressure before the pressure drop Pr0:

$$\Delta Pr = Pr\mathbf{0} - [\Sigma(k=0 \rightarrow a)\ P\text{peak}(k)]/(a+1)$$

As the common-rail pressure before the pressure drop Pr0 is usually known in advance, the amount of pressure drop ΔPr may be obtained by a formula modified as follows:

$$\Delta Pr = [\Sigma(k=0 \rightarrow a)\ (Pr\mathbf{0} - P\text{peak}(k))]/(a+1)$$

Although but the calculations regarding the common-rail pressure in the embodiments described above is shown accomplished by the use of DSP or high-speed A/D converter, any CPU may be used, provided that the CPU has the enough ability. In addition, the learning may start from the small pulse width Pw3, as opposed to the learning order described above, in which the pulse width Pw is made decrement from the Pwstart.

It will be understood that the foregoing description is of preferred exemplary embodiment of the present invention and that the invention is not limited to the specific forms shown.

What is claimed is:

1. A common-rail fuel-injection system comprising a common rail to store therein pressurized fuel, injectors each of which is arranged in a cylinder, to inject the fuel supplied from the common rail into the cylinders, sensor means to monitor engine operating conditions, a pressure detector to monitor pressure in the common rail, and a control unit to find fuel-injection factors including a desired amount of fuel to be injected, depending on signals detected from the sensor means, and further calculate an amount of pressure drop taking place in the common-rail due to a fuel injection of each injector, depending on signal detected from the pressure detector, thereby compensating for the desired amount of fuel to be injected from each injector, depending on a deviation of an actual amount of fuel injected from each injector, which is found based on the amount of pressure drop, from the desired amount of fuel to be injected, and wherein the control unit calculates a mean pressure after fuel injection by averaging pulsating pressures that occur in the common rail owing to the fuel injection, and derives the amount of pressure drop in the common rail from a difference in pressure between the mean pressure after fuel injection and a pressure before fuel injection in the common rail, wherein the control unit finds an extreme value in the common-rail pressure, where a derivative of the common-rail pressure becomes zero after the beginning of the pressure drop in the common-rail pressure, and calculates the mean pressure after fuel injection by averaging the extreme values, which happen successively in the common-rail pressure.

2. A common-rail fuel-injection system constructed as defined in claim 1, wherein the control unit outputs a command signal to actuate the injector in accordance with the injection factors, and derives the pressure before fuel injection from values of the common-rail pressure sampled during a time interval between a timing the command pulse starts and a later timing the common-rail pressure drops due to the fuel injection.

3. A common-rail fuel-injection system constructed as defined in claim 1, wherein the extreme values to be averaged are maximum and minimum extreme values that occur in either a first one cycle or early cycle of the pulsating pressure remaining in the common-rail.

4. A common-rail fuel-injection system constructed as defined in claim 1, wherein the control unit finds deviations of the extreme values in the common-rail pressure from the pressure before fuel injection, and derives the amount of pressure drop from a mean value of the deviations.

5. A common-rail fuel-injection system comprising a common rail to store therein pressurized fuel, injectors each of which is arranged in a cylinder, to inject the fuel supplied from the common rail into the cylinders, sensor means to monitor engine operating conditions, a pressure detector to monitor pressure in the common rail, and a control unit to find fuel-injection factors including a desired amount of fuel to be injected, depending on signals detected from the sensor means, and further calculate an amount of pressure drop taking place in the common-rail due to a fuel injection of each injector, depending on signal detected from the pressure detector, thereby compensating for the desired amount of fuel to be injected from each injector, depending on a deviation of an actual amount of fuel injected from each injector, which is found based on the amount of pressure drop, from the desired amount of fuel to be injected, and wherein the control unit calculates a mean pressure after fuel injection by averaging pulsating pressures that occur in the common rail owing to the fuel injection, and derives the amount of pressure drop in the common rail from a difference in pressure between the mean pressure after fuel injection and a pressure before fuel injection in the common rail, wherein the control unit finds a mean value of the amounts of pressure drop averaging the values of the amounts of pressure drop that are successively calculated about each injector, and considers the mean value to be the amount of pressure drop in the common-rail pressure.

6. A common-rail fuel-injection system comprising a common rail to store therein pressurized fuel, injectors each of which is arranged in a cylinder, to inject the fuel supplied from the common rail into the cylinders, sensor means to monitor engine operating conditions, a pressure detector to monitor pressure in the common rail, and a control unit to find fuel-injection factors including a desired amount of fuel to be injected, depending on signals detected from the sensor means, and further calculate an amount of pressure drop taking place in the common-rail due to a fuel injection of each injector, depending on signal detected from the pressure detector, thereby compensating for the desired amount of fuel to be injected from each injector, depending on a deviation of an actual amount of fuel injected from each injector, which is found based on the amount of pressure drop, from the desired amount of fuel to be injected, and wherein the control unit calculates a mean pressure after fuel injection by averaging pulsating pressures that occur in the common rail owing to the fuel injection, and derives the amount of pressure drop in the common rail from a difference in pressure between the mean pressure after fuel injection and a pressure before fuel injection in the common rail, wherein the control unit outputs a command pulse to actuate the injector in accordance with the injection factors, with detecting whether or not the engine operates under a steady state, and acquires a correlative data between the command pulse and the amount of fuel injected through a learning process that is executed, when the engine operates under steady state, as to the command pulse output and the actual amount of fuel injected, which is found based on the amount of pressure drop in the common-rail pressure resulting from the fuel injection out of the injector actuated with the command pulse.

7. A common-rail fuel-injection system constructed as defined in claim 6, wherein the control unit uses the correlative data when the amount of fuel injected is a minute amount of fuel that is not more than a preselected amount.

8. A common-rail fuel-injection system constructed as defined in claim 7, wherein the control unit finds an injection factor of a main injection and another injection factor of a pilot injection to inject the minute amount of fuel prior to the main injection, and regulates the minute amount of fuel injected in the pilot injection with an open-loop control system on the basis of the correlative data acquired through the learning process.

9. A common-rail fuel-injection system constructed as defined in claim 1, wherein the fuel is deliverd to the common rail with pumping action of a fuel-supply plunger pump in response to the fuel injection out of the injector, and the control unit governs, depending on the injection factor, an amount of fuel delivered out of the fuel-supply plunger pump.

* * * * *